US010988697B2

(12) United States Patent
Raja et al.

(10) Patent No.: US 10,988,697 B2
(45) Date of Patent: Apr. 27, 2021

(54) PROCESS FOR UPGRADING HEAVY HYDROCARBONS

(71) Applicant: HINDUSTAN PETROLEUM CORPORATION LIMITED, Mumbai (IN)

(72) Inventors: Kanuparthy Naga Raja, Hoskote Bangalore (IN); Pudi Satyanarayana Murty, Hoskote Bangalore (IN); Bhavesh Sharma, Hoskote Bangalore (IN); Peddy Venkata Chalapathi Rao, Hoskote Bangalore (IN); Nettem Venkateswarlu Choudary, Hoskote Bangalore (IN); Sriganesh Gandham, Hoskote Bangalore (IN)

(73) Assignee: Hindustan Petroleum Corporation Limited, Mumbai (IN)

( * ) Notice: Subject to any disclaimer, the term of this patent is extended or adjusted under 35 U.S.C. 154(b) by 81 days.

(21) Appl. No.: 16/335,967

(22) PCT Filed: Sep. 29, 2017

(86) PCT No.: PCT/IB2017/055990
§ 371 (c)(1),
(2) Date: Mar. 22, 2019

(87) PCT Pub. No.: WO2018/060938
PCT Pub. Date: Apr. 5, 2018

(65) Prior Publication Data

US 2020/0231884 A1 Jul. 23, 2020

(30) Foreign Application Priority Data

Sep. 30, 2016 (IN) ..... 201621033584

(51) Int. Cl.
*C10G 47/26* (2006.01)
*C10G 65/10* (2006.01)
*C10G 67/02* (2006.01)
*C10G 1/00* (2006.01)

(52) U.S. Cl.
CPC ..... *C10G 67/02* (2013.01); *C10G 1/002* (2013.01); *C10G 2300/107* (2013.01); *C10G 2400/04* (2013.01); *C10G 2400/08* (2013.01)

(58) Field of Classification Search
CPC ..... C10G 1/002; C10G 47/26; C10G 65/10
See application file for complete search history.

(56) References Cited

U.S. PATENT DOCUMENTS

2009/0095655 A1* 4/2009 Kokayeff ..... C10G 65/12 208/59

FOREIGN PATENT DOCUMENTS

| | | |
|---|---|---|
| EP | 0436253 | 7/1991 |
| GB | 1221275 | 2/1971 |
| WO | 2014120490 | 8/2014 |

* cited by examiner

*Primary Examiner* — Randy Boyer
(74) *Attorney, Agent, or Firm* — Sand, Sebolt & Wernow Co., LPA

(57) ABSTRACT

The present invention discloses a process by which the heavy hydrocarbons are subjected to hydroprocessing for producing distillates which can be further treated or converted downstream, to fuels and chemicals.

6 Claims, 1 Drawing Sheet

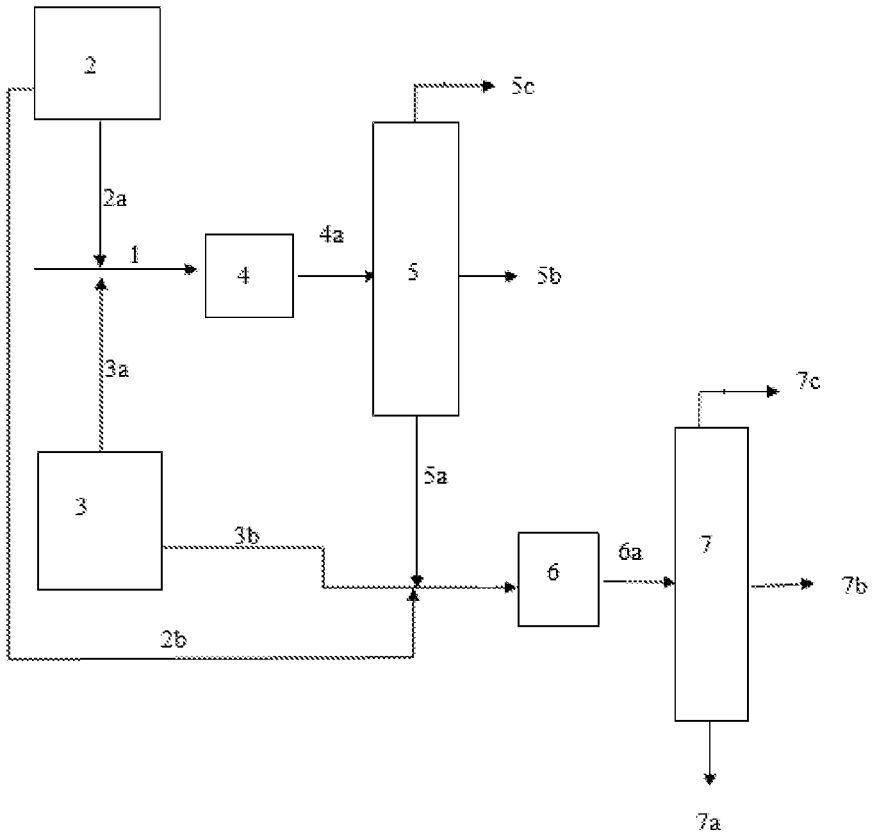
2
2a
1
4
4a
5
5c
5b
3a
3
3b
5a
6
6a
7
7c
7b
7a
2b

PROCESS FOR UPGRADING HEAVY HYDROCARBONS

FIELD

The present disclosure relates to the field of upgrading heavy hydrocarbons.

Definitions

As used in the present disclosure, the following terms are generally intended to have the meaning as set forth below, except to the extent that the context in which they are used indicate otherwise.

Arab heavy crude oil refers to the crude oil obtained from Saudi Arabia.

SIMDIST refers to simulated distillation which is a gas chromatography (GC) based method for the characterization of petroleum products.

ASTM D-7169 is a test that determines the boiling point distribution and cut point intervals of the crude oil and residues using high temperature gas chromatography.

BACKGROUND

Conventionally, in petroleum refineries, distillation units are used for transforming crude oil into valuable fuel products having different boiling fractions. These straight run products are separated and treated by using different processes in order to meet the product quality that can be marketed. In the conventional process, the conversion of crude oil can be increased by increasing the number of process units such as distillation columns. However, this increases the complexity of the entire process.

The global demand for distillates is growing exponentially. In order to maximize the yield of such distillates, hydrocracking process is used to convert heavy hydrocarbons into more valuable distillates under hydrogen atmosphere. Hydroprocessing or hydrocracking is particularly carried out at the downstream of process units such as distillation columns, after crude oil is separated into straight run products. In hydroprocessing, hydrocarbons, which include naphtha, gas oils, and cycle oils are treated to remove sulfur and nitrogen content from the hydrocarbons or reformed to obtain light hydrocarbons with the increased octane number.

Conventionally, in refineries, crude oil is separated into various fractions and the fractions are individually processed in separate hydro-processing units, thereby increasing the consumption of energy and making the entire process non-economical. Moreover, due to the stringent environmental norms, focus is given to hydroprocessing technologies so as to obtain products with reduced consumption of energy.

There is, therefore, felt a need for a process that increases the yield of valuable petroleum fractions.

Objects

Some of the objects of the present disclosure, which at least one embodiment herein satisfies, are as follows.

It is an object of the present disclosure to ameliorate one or more problems of prior art or to at least provide a useful alternative.

An object of the present disclosure is to provide a process for upgrading heavy hydrocarbons to obtain lighter hydrocarbons.

Another object of the present disclosure is to provide a process for upgrading heavy hydrocarbons that is simple and economical.

Other objects and advantages of the present disclosure will be more apparent from the following description, which is not intended to limit the scope of the present disclosure.

SUMMARY

The present disclosure is related to a process for upgrading heavy hydrocarbons to obtain light distillates.

A process for upgrading heavy hydrocarbons comprises hydrocracking a heavy hydrocarbon feed in a first hydrocracker in the presence of a catalyst and hydrogen gas at a temperature in the range of 300° C. to 500° C., preferably in the range of 380° C. to 480° C. and at a pressure in the range of 2 to 160 bar, preferably in the range of 10 bar to 100 bar, for a time period in the range of 15 minutes to 4 hours to obtain a first effluent. The first effluent is then fractionated to obtain light distillates comprising hydrocarbons with boiling points below 180° C., middle distillates comprising hydrocarbons with boiling points in the range of 180° C. to 370° C. and atmospheric bottoms comprising hydrocarbons with boiling points above 370° C.

The atmospheric bottoms comprising hydrocarbons with boiling points above 370° C. are subjected to further hydrocracking in a second hydrocracker at a temperature in the range of 300° C. to 500° C., preferably in the range of 380° C. to 480° C. and at a pressure in the range of 2 bar to 250 bar, preferably in the range of 25 bar to 200 bar in the presence of the catalyst and hydrogen gas for a time period in the range of 0.5 hour to 6 hours to obtain a second effluent. The second effluent so obtained is further sent to a separation zone to separate distillates comprising hydrocarbons with boiling points below 370° C., vacuum gas oil comprising hydrocarbons with boiling points in the range of 370° C. to 540° C. and vacuum residue comprising hydrocarbons with boiling points above 540° C.

BRIEF DESCRIPTION OF THE ACCOMPANYING DRAWING

The present disclosure will now be described with the help of the accompanying drawing, in which:

FIG. 1 illustrates a schematic representation of an embodiment of the process of the present disclosure to increase light distillates yields obtained from hydrocracking of heavy hydrocarbons.

LIST OF REFERENCE NUMERALS

| | |
|---|---|
| HEAVY HYDROCARBON FEED | 1 |
| CATALYST TANK | 2 |
| FIRST CATALYST STREAM | 2a |
| SECOND CATALYST STREAM | 2b |
| HYDROGEN TANK | 3 |
| FIRST HYDROGEN STREAM | 3a |
| SECOND HYDROGEN STREAM | 3b |
| FIRST HYDROCRACKER | 4 |
| FIRST EFFLUENT | 4a |
| FRACTIONATOR | 5 |
| ATMOSPHERIC BOTTOMS | 5a |
| MIDDLE DISTILLATES | 5b |
| LIGHT DISTILLATES | 5c |
| SECOND HYDROCRACKER | 6 |
| SECOND EFFLUENT | 6a |
| SEPARATION ZONE | 7 |

-continued

| | |
|---|---|
| VACUUM RESIDUE | 7a |
| VACUUM GAS OIL | 7b |
| DISTILLATES | 7c |

DETAILED DESCRIPTION

The present disclosure provides a process, particularly an integrated process, for upgrading heavy hydrocarbons in a refinery to obtain light distillates.

Conventionally, the refinery operates in a mode in which the crude oil is separated into various fractions and is processed independently in one or more hydro-processing units. However, this practice makes the process complicated and expensive.

The present disclosure provides a simple and economical process for upgrading the heavy hydrocarbon feed to obtain light distillates. The process of the present disclosure involves following steps:

Initially, heavy hydrocarbon feed is hydrocracked at a temperature in the range of 300° C. to 500° C., preferably in the range of 380° C. to 480° C. and at a pressure in the range of 2 bar to 160 bar, preferably in the range of 10 bar to 100 bar, in a first hydro-cracker in the presence of a catalyst from a catalyst tank and hydrogen gas for a time period in the range of 15 minutes to 4 hours to obtain a first effluent comprising hydro-cracked products.

In accordance with embodiments of the present disclosure, the amount of the catalyst is in the range of 0.001 wt % to 10 wt %, preferably in the range of 0.01 wt % to 3 wt %.

The first effluent obtained from the first hydro-cracker is introduced into a fractionator, wherein it is separated into light distillates comprising hydrocarbons with boiling point below 180° C., middle distillates comprising hydrocarbons with boiling point in the range of 180° C. to 370° C. and atmospheric bottoms comprising hydrocarbons with boiling point above 370° C.

The atmospheric bottom stream comprising hydrocarbons with boiling points above 370° C. is further subjected to a second hydro-cracking in a second hydro-cracker in the presence of a second fraction of the catalyst and hydrogen gas at a temperature in the range of 300° C. to 500° C., preferably in the range of 380 to 480° C. and at a pressure in the range of 2 bar to 250 bar, preferably in the range of 25 to 200 bar and for a time period in the range of 0.5 hour to 6 hours to obtain a second effluent comprising hydro-cracked products.

In accordance with embodiments of the present disclosure, the amount of the catalyst is in the range of 0.01 wt % to 10 wt %, preferably in the range of 0.01 wt % to 3 wt %.

The second effluent obtained from the second hydrocracker is further sent to a separation zone which comprises of, but is not limited to, separators, atmospheric distillation column and vacuum distillation column for the separation of cracked product stream into distillates comprising hydrocarbons with boiling point below 370° C., vacuum gas oil comprising hydrocarbons with boiling point in the range of 370° C. to 540° C. and vacuum residue comprising hydrocarbons with boiling point above 540° C.

In accordance with an embodiment of the present disclosure, a portion of atmospheric bottoms stream obtained from the fractionator may be recycled to the first hydrocracker.

In accordance with an embodiment of the present disclosure, a portion of vacuum residue and a portion of vacuum gas oils obtained from the separation zone are recycled to the second hydrocracker.

In accordance with an embodiment of the present disclosure, silicone based antifoaming agents like polydimethylsiloxanes, corrosion inhibitors, bio-surfactants based on sulphonic acids, may be added to the heavy hydrocarbon feed (1) before introducing it into the hydrocracker.

In accordance with the embodiments of the present disclosure, the catalyst used in first hydro-cracker and/or the second hydrocracker is introduced in at least one form selected from the group consisting of colloidal dispersed form, slurry phase dispersed form and oil soluble catalyst form. In accordance with an exemplary embodiment of the present disclosure, the catalyst is introduced in the slurry form.

In accordance with the embodiments of the present disclosure, the catalyst comprises at least one metal or at least one metal compound of a metal selected from the group consisting of chromium, manganese, iron, cobalt, nickel, zirconium, niobium, molybdenum, tungsten, ruthenium, rhodium, tin, tantalum and combinations thereof. In accordance with an exemplary embodiment of the present disclosure, the catalyst comprises molybdenum.

In accordance with the embodiments of the present disclosure, the first hydrocracker and the second hydrocracker are independently selected from the group consisting of continuously stirred tank reactors, fixed bed reactors, slurry bubble column reactors, ebullated bed reactors or combinations thereof. In accordance with an embodiment of the present disclosure, the first hydrocracker and second hydrocracker comprise reactors in at least one configuration selected from the group consisting of series, parallel and series-parallel.

The process of the present disclosure can be performed using a system represented by FIG. 1.

A heavy hydrocarbon feed (1), of which the non-limiting examples include crude oil, tar sands, bituminous oil, oil sands bitumen, shale oil, Coker distillates, Slurry oil from fluid catalytic cracking unit, unconverted oil from VGO hydrocracker, Gas oils and Visbreaker Tar from Visbreaker unit and any of their combinations is mixed with hydrogen gas (3*a*) received from a hydrogen tank (3), and a catalyst (2*a*) received from a catalyst tank (2), and is sent to a hydrocracker (4) where the heavy hydrocarbon feed (1) is subjected to hydrocracking to obtain the first effluent (4*a*).

In an embodiment, the hydrocracking can be carried out at a temperature in the range of 300° C. to 500° C., preferably in the range of 380 to 480° C. and at a pressure in the range of 2 bar to 160 bar, preferably in the range of 10 bar to 100 bar.

In accordance with an embodiment of the present disclosure, silicone based antifoaming agents like polydimethylsiloxanes, corrosion inhibitors, bio-surfactants based on sulphonic acids, may be added to the heavy hydrocarbon feed (1) before introducing it into the first hydrocracker (4).

In accordance with an embodiment of the present disclosure, the heavy hydrocarbon feed is preheated in a preheating zone at a temperature below 350° C., before introducing to the first hydrocracker.

The first effluent (4*a*) comprising cracked products from the hydrocracker (4) are then received in a fractionator (5) to separate the light distillates (5*c*), middle distillates (5*b*) and atmospheric bottoms (5*a*). The product fractions are separated based on their boiling ranges. The light distillate stream (5*c*) comprises hydrocarbons with boiling points below 180° C., the middle distillate stream (5*b*) comprises hydrocarbons with boiling points in the range of 180° C. to 370° C., while the atmospheric bottoms stream (5*a*) comprises of hydrocarbons with boiling points above 370° C. In accordance with an embodiment of the present disclosure, the fractionator (5) is at least one atmospheric fractionation column.

In accordance with an embodiment of the present disclosure, a portion of atmospheric bottoms stream (5*a*) may be recycled to the first hydrocracker (4).

The light distillate stream (5*c*) includes produced hydrogen gas, dry gas, liquefied petroleum gas (LPG) and naphtha. In accordance with the present disclosure, naphtha may be sent to Isomerization unit or to Catalytic reforming unit. The middle distillate stream (5*b*) includes kerosene and diesel. In accordance with an embodiment of the present disclosure, the middle distillate stream (5*b*) can be hydrotreated to remove impurities such as sulphur, nitrogen, and the like contained therein.

The atmospheric bottoms (5*a*) are mixed with hydrogen gas (3*b*) received from the hydrogen tank (3), and the catalyst (2*b*) received from the catalyst tank (2), and sent to a second hydrocracker (6) where the atmospheric bottoms (5*a*) are subjected to hydrocracking to obtain a second effluent.

In accordance with an embodiment of the present disclosure, silicone based antifoaming agents like polydimethylsiloxanes, corrosion inhibitors, bio-surfactants based on sulphonic acids, may be added to the atmospheric bottom stream (5*a*) before introducing it into the second hydrocracker (6).

The second effluent (6*a*) comprising cracked products from the hydrocracker (6) is then sent to a separation Zone (7) which comprises of, but is not limited to, separators, atmospheric distillation column and vacuum distillation column for separation of the cracked stream into distillates (7*c*), vacuum gas oil (7*b*) and vacuum residue (7*a*).

In accordance with the process of the present disclosure, a portion of vacuum gas oils (7*b*) along with a portion of vacuum residue (7*a*) is recycled to the second hydrocracker (6).

In accordance with the process of the present disclosure, hydrogen gas is produced during the hydro-cracking process in the range of 0.2 to 17 wt % of the fresh feed charged. The hydrogen gas which is produced in this process may be utilized within the refinery, thereby making the process cost effective.

Further, a portion of vacuum gas oils comprising hydrocarbons with boiling points above 370° C. and less than 540° C., from the second hydro-cracker can be processed in other processing units such as fluid catalytic cracking unit, hydrocracker, delayed coker, visbreaker, bitumen blowing unit and lube processing unit.

The process of the present disclosure is capable of obtaining light hydrocarbons with increased yield by processing bottoms obtained from fractionators in hydrocrackers.

The present disclosure is further described in light of the following experiments which are set forth for illustration purpose only and not to be construed for limiting the scope of the disclosure. The following laboratory scale experiment can be scaled up to industrial/commercial scale.

EXPERIMENTAL DETAILS

Experiment 1: Hydro-Cracking of Arab Heavy Crude Oil

An experimental hydrocracker (Batch reactor) was charged with 100 g of crude oil and catalyst slurry containing 3000 ppm molybdenum. The experimental hydrocracker was purged with nitrogen to remove any air present inside. After purging of nitrogen, the experimental hydrocracker was pressurized with hydrogen to 15 bar.

The crude oil was hydrocracked at 420° C. in the presence of hydrogen and the catalyst slurry under continuous stirring at 1000 rpm for 20 minutes to obtain first effluent comprising hydrocracked products.

The first effluent was fed to an experimental atmospheric fractionation column, wherein various fractions were separated based on the boiling points, to obtain a top fraction having boiling point less than 180° C., a middle fraction having boiling point above 180° C. and below 370° C. and atmospheric bottoms having boiling point above 370° C. as per ASTM D86.

The atmospheric bottoms from the atmospheric fractionation column were hydrocracked, in the presence of hydrogen and the catalyst slurry containing 5000 ppm molybdenum, at a temperature of 420° C. and at a pressure of 175 bar for 4 hours, to obtain a second effluent comprising a hydrocracked products.

The second effluent was separated to different cut points as per ASTM D86 and ASTM D5236. The liquid products from the experimental fractionator were collected separately and were analyzed using GC-SIMDIST as per ASTM D-7169.

The difference in the yields of light hydrocarbons with or without using the process steps of the present disclosure is summarized in Table 1.

| Fraction obtained | Feed (Conventional process) wt % | Product (Process of the present disclosure) wt % | Difference in yield, wt % |
|---|---|---|---|
| <180° C. | 11.9 | 43 | +31.1 |
| >180° C. & <370° C. | 27.1 | 53.1 | +26 |
| >370° C. | 61 | 3.9 | −57.1 |

From Table 1, it is evident that the yield of lighter hydrocarbons (<180° C.) obtained by using the process of the present disclosure is greater than that obtained by using the conventional process. From Table-1, it is also observed that using the conventional process, the yield of the fractions having boiling point >180° C. & <370° C. is 27.1 wt % and the yield of the fractions having boiling point >370° C. is 61 wt %. However, by using the process step of the present disclosure, the yield of the fractions having boiling point between 180° C. and 370° C. is comparatively increased and the yield of the heavier fractions having boiling point >370° C. is significantly reduced. This indicates that by using the process steps of the present disclosure, the yield of lighter hydrocarbons is improved.

The experimental results can be extrapolated for the pilot plant and/or the industrial plant experiments.

Technical Advancements

The present disclosure described herein above has several technical advantages including, but not limited to, the realization of a process that:

provides increased yield of light distillates; and is simple and economical.

The embodiments as described herein above, and various features and advantageous details thereof are explained with reference to the non-limiting embodiments in the description. Descriptions of well-known aspects and components are omitted so as to not unnecessarily obscure the embodiments herein.

The foregoing description of specific embodiments so fully reveal the general nature of the embodiments herein, that others can, by applying current knowledge, readily modify and/or adapt for various applications of such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein. Further, it is to be distinctly understood that the foregoing descriptive matter is to be interpreted merely as illustrative of the disclosure and not as a limitation.

Having described and illustrated the principles of the present disclosure with reference to the described embodiments, it will be recognized that the described embodiments can be modified in arrangement and detail without departing from the scope of such principles.

While considerable emphasis has been placed herein on the particular features of this disclosure, it will be appreciated that various modifications can be made, and that many changes can be made in the preferred embodiment without departing from the principles of the disclosure. These and other modifications in the nature of the disclosure or the preferred embodiments will be apparent to those skilled in the art from the disclosure herein, whereby it is to be distinctly understood that the foregoing descriptive matter is to be interpreted merely as illustrative of the disclosure and not as a limitation.

The invention claimed is:

1. A process for upgrading heavy hydrocarbons to obtain light distillates; said process comprising:

a. hydrocracking the hydrocarbon feed in a first hydrocracker in the presence of a catalyst and hydrogen gas, at a temperature in the range of 380° C. to 480° C. and under a pressure in the range of 10 bar to 100 bar, for a time period in the range of 15 minutes to 4 hours to obtain a first effluent;

b. fractionating said first effluent to obtain light distillates comprising hydrocarbons with boiling points below 180° C., middle distillates comprising hydrocarbons with boiling points in the range of 180° C. to 370° C. and atmospheric bottoms comprising hydrocarbons with boiling points above 370° C.;

c. hydrocracking the atmospheric bottoms in a second hydrocracker in the presence of a catalyst and hydrogen gas, at a temperature in the range of 380° C. to 480° C. and under pressure in the range of 25 bar to 200 bar, for a time period in the range of 0.5 hour to 6 hours to obtain a second effluent; and d. fractionating the second effluent to obtain distillates comprising hydrocarbons with boiling points below 370° C., vacuum gas oil comprising hydrocarbons with boiling points in the range of 370° C. to 540° C. and vacuum residue comprising hydrocarbons with boiling points above 540° C.;

wherein the catalyst used in step (a) and/or (c) is introduced in a form selected from the group consisting of colloidally dispersed form, slurry form, and oil soluble form.

2. The process as claimed in claim 1, wherein said hydrocarbon feed comprises at least one feed selected from the group consisting of crude oil, tar sands, bituminous oil, oil sands bitumen, shale oil, coker distillates, slurry oil from fluid catalytic cracking unit, unconverted oil from VGO hydrocracker, visbreaker gas oils, visbreaker tar and combination thereof.

3. The process as claimed in claim 1, wherein the catalyst used in step (a) and/or (c) comprises at least one metal or a metallic compound of a metal selected from the group consisting of chromium, manganese, iron, cobalt, nickel, zirconium, niobium, molybdenum, tungsten, ruthenium, rhodium, tin, tantalum and combinations thereof.

4. The process as claimed in claim 1, wherein the amount of catalyst used in step (a) is in the range of 0.001 wt % to 10 wt % and the amount of catalyst used in step (c) is in the range of 0.01 wt % to 10 wt %.

5. The process as claimed in claim 1, wherein a portion of vacuum residue and a portion of vacuum gas oils obtained in step (d) are recycled to the second hydrocracker.

6. The process as claimed in claim 1, wherein in the process step (a), hydrogen is produced in the range of 0.2 wt % to 17 wt %.

* * * * *